US005312668A

United States Patent [19]

Brown

[11] Patent Number: 5,312,668

[45] Date of Patent: May 17, 1994

[54] PAPER SPLICE MEMBER

[76] Inventor: Kirk D. Brown, 121 S. Burris Ave., Compton, Calif. 90221

[21] Appl. No.: 941,712

[22] Filed: Sep. 8, 1992

[51] Int. Cl.[5] ..... B32B 3/06

[52] U.S. Cl. ..... 428/99; 428/61; 428/98; 156/157

[58] Field of Search ..... 428/58, 61, 99, 120, 428/98; 156/304.3, 157

[56] References Cited

U.S. PATENT DOCUMENTS 4,938,820 7/1990 McMills ..... 428/61

*Primary Examiner*—Alexander S. Thomas
*Attorney, Agent, or Firm*—Leon Gilden

[57] ABSTRACT

A paper splice member includes first and second flexible webs medially intersecting one another, wherein the webs define a longitudinally aligned unitary splicing member to accommodate free ends of the first and second paper sheets to provide for assembly of the paper sheets for continuous paper feed. A plurality of confronting surfaces are arranged on opposed sides of the first and second webs to secure the free ends of the paper sheets therebetween.

2 Claims, 4 Drawing Sheets

PAPER SPLICE MEMBER

BACKGROUND OF THE INVENTION

1. Field of the Invention

The field of invention relates to paper slicing structure, and more particularly pertains to a new and improved paper splice member wherein the same receives opposed free ends of paper sheets to provide for continuous paper feed of the paper sheets.

2. Description of the Prior Art

Paper splicing structure is arranged in the instant invention to permit bonding of confronting free end portions of first and second paper sheets to permit continuous feed of the paper sheets. Prior art splicing has typically been confined to use with automatic machinery such as indicated in U.S. Pat. Nos. 3,861,612 to Kubo and 5,018,535 to Dasilva, et al.

The instant invention permits the continuous feed of a plurality of sheets by employing a manually applied splicing member to secure the free ends of the opposing sheets and in this respect, the present invention substantially fulfills this need.

SUMMARY OF THE INVENTION

In view of the foregoing disadvantages inherent in the known types of paper splice structure now present in the prior art, the present invention provides a paper splice member wherein the same utilizes intersecting first and second webs arranged to receive free ends of first and second paper sheet members arranged in a longitudinally aligned relationship to permit continuous feed of the paper sheet members. As such, the general purpose of the present invention, which will be described subsequently in greater detail, is to provide a new and improved paper splice member which has all the advantages of the prior art paper splice structure and none of the disadvantages.

To attain this, the present invention provides a paper splice member including first and second flexible webs medially intersecting one another, wherein the webs define a longitudinally aligned unitary splicing member to accommodate free ends of the first and second paper sheets to provide for assembly of the paper sheets for continuous paper feed. A plurality of confronting surfaces are arranged on opposed sides of the first and second webs to secure the free ends of the paper sheets therebetween.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paper splice member which has all the advantages of the prior art paper splice structure and none of the disadvantages.

It is another object of the present invention to provide a new and improved paper splice member which may be easily and efficiently manufactured and marketed.

It is a further object of the present invention to provide a new and improved paper splice member which is of a durable and reliable construction.

An even further object of the present invention is to provide a new and improved paper splice member which is susceptible of a low cost of manufacture with regard to both materials and labor, and which accordingly is then susceptible of low prices of sale to the consuming public, thereby making such paper splice members economically available to the buying public.

Still yet another object of the present invention is to provide a new and improved paper splice member which provides in the apparatuses and methods of the prior art some of the advantages thereof, while simultaneously overcoming some of the disadvantages normally associated therewith.

There together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
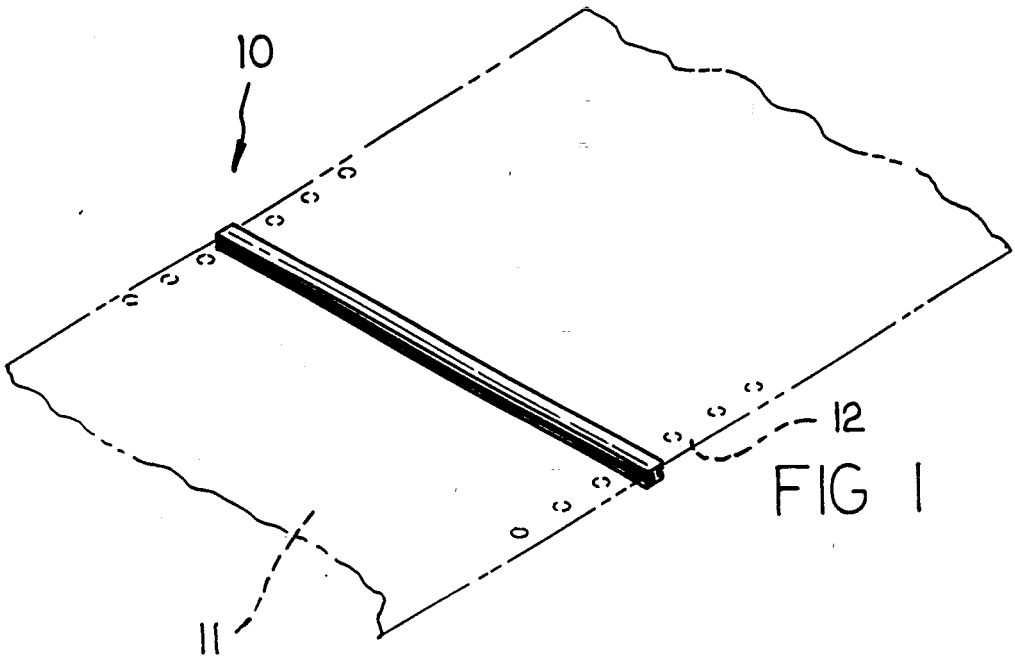
FIG. 1 is an isometric illustration of the invention in use.
Figure 2:
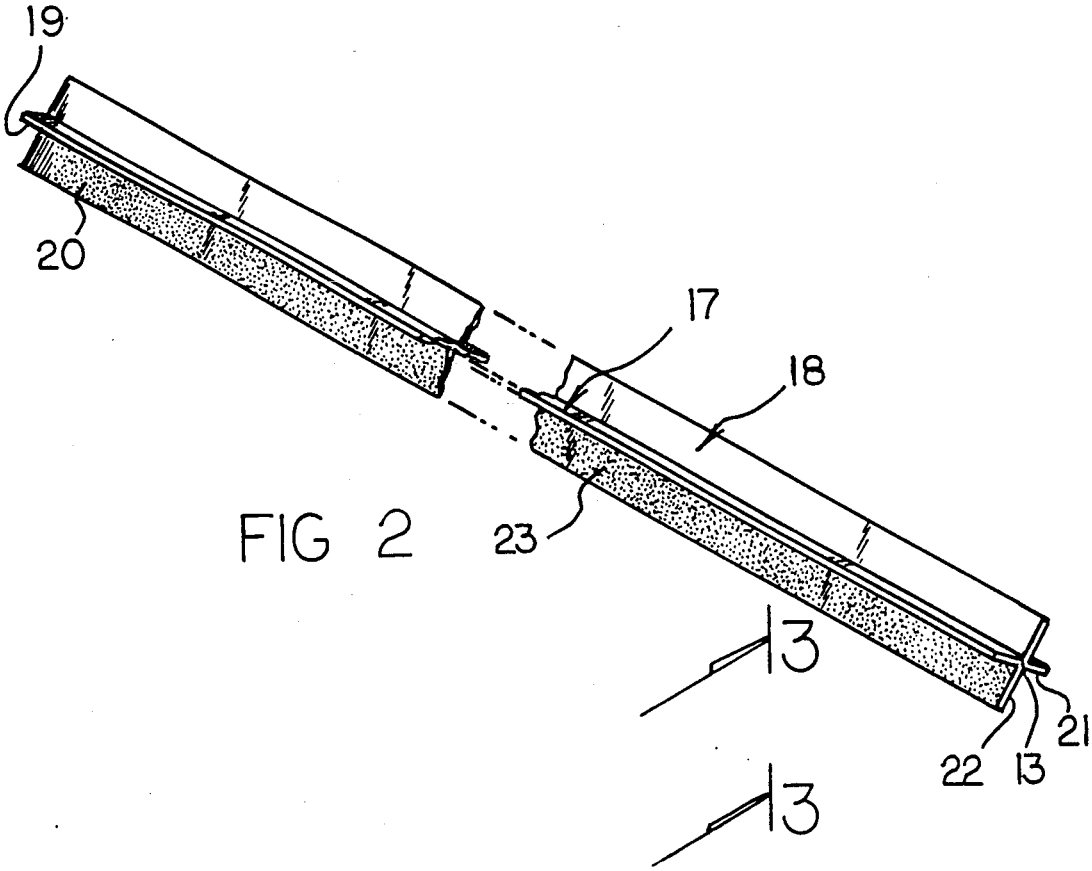
FIG. 2 is an enlarged isometric illustration of the invention.
Figure 3:
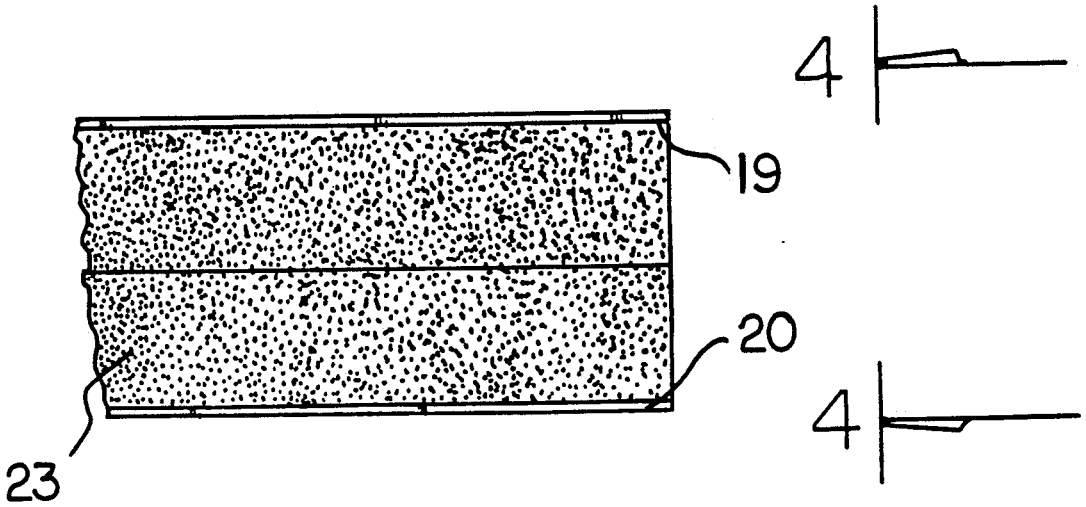
FIG. 3 is an orthographic view, taken along the lines 3—3 of FIG. 2 in the direction indicated by the arrows.
Figure 4:
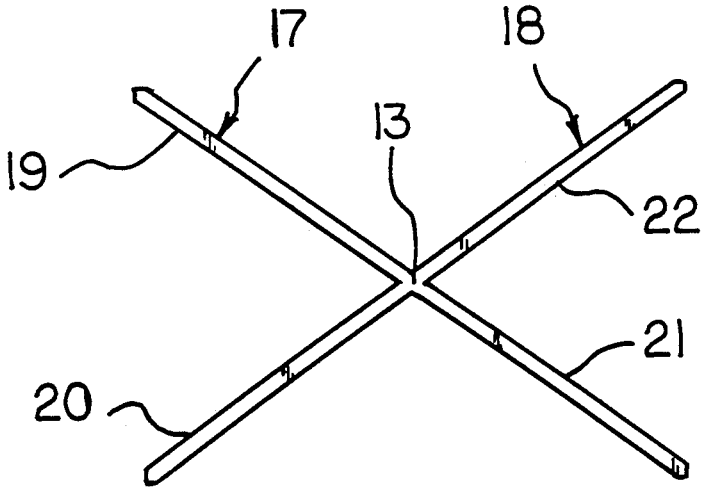
FIG. 4 is an orthographic view, taken along the lines 4—4 of FIG. 3 in the direction indicated by the arrows.

With reference now to the drawings, and in particular to FIGS. 1 to 8 thereof, a new and improved paper splice member embodying the principles and concepts of the present invention and generally designated by the reference numeral 10 will be described.

More specifically, the paper splice member 10 of the instant invention essentially comprises the joining of a first paper sheet 11 to a second paper sheet 12 in a longitudinally aligned relationship to permit continuous feed of the first and second paper sheets. The member 10 includes a first flexible web 17 medially intersecting a second flexible web 18 at a web intersection 13. The web intersection 13 is longitudinally aligned and is of a resilient shape-retentive material. The first web 17 includes a first web interior surface 19 arranged in confronting and coextensive relationship relative to a second web interior surface 20. The first web further includes a first web second interior surface 21 that is in confronting relationship relative to a second web second interior surface 22. Each of the interior surfaces 19–22 are coated with an adhesive layer 23 that is coextensive relative to each of the interior surfaces. The first web first and second interior surfaces 19 and 21 are positioned on opposed sides of the intersection 13, wherein similarly, the second web first and second interior surfaces 20 and 22 are positioned on opposed sides of the intersection 13. The first and second webs first interior surfaces 19 and 20 are arranged to receive a first paper sheet 11, wherein the first and second webs second interior surfaces 21 and 22 are arranged to receive the second paper sheet 12.

Figure 5:
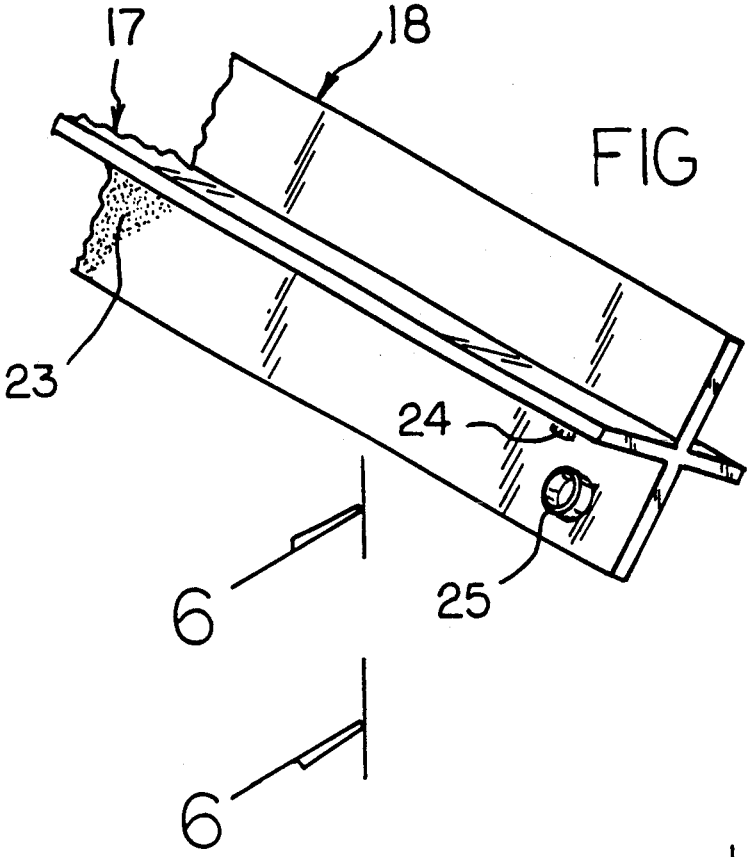
FIG. 5 is an isometric illustration of the invention indicating further employment of mechanical fastening structure.
Figure 6:
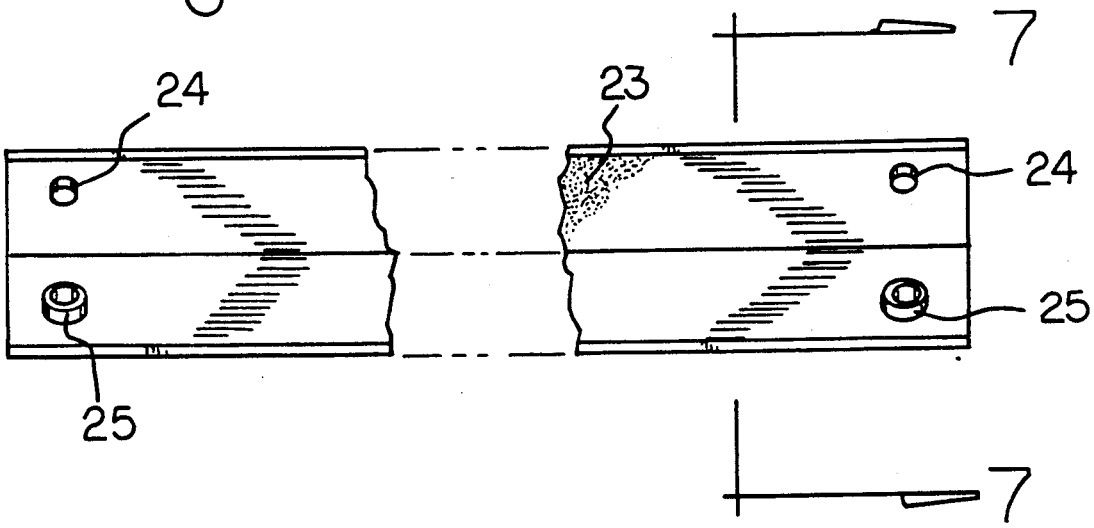
FIG. 6 is an orthographic view, taken along the lines 6—6 of FIG. 5 in the direction indicated by the arrows.
Figure 7:
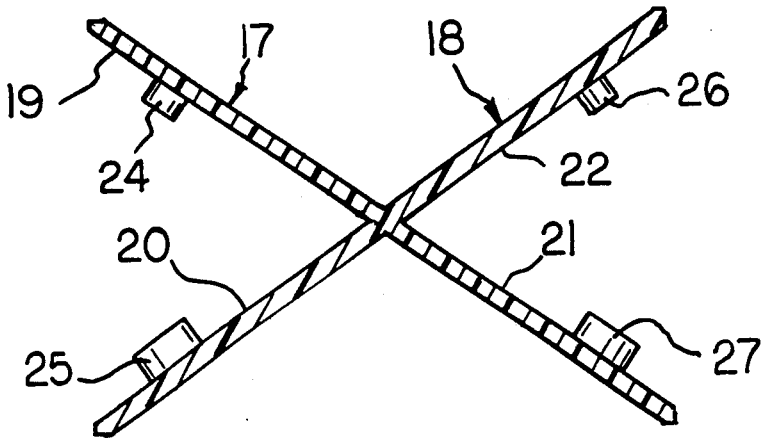
FIG. 7 is an orthographic view, taken along the lines 7—7 of FIG. 6 in the direction indicated by the arrows.
Figure 8:
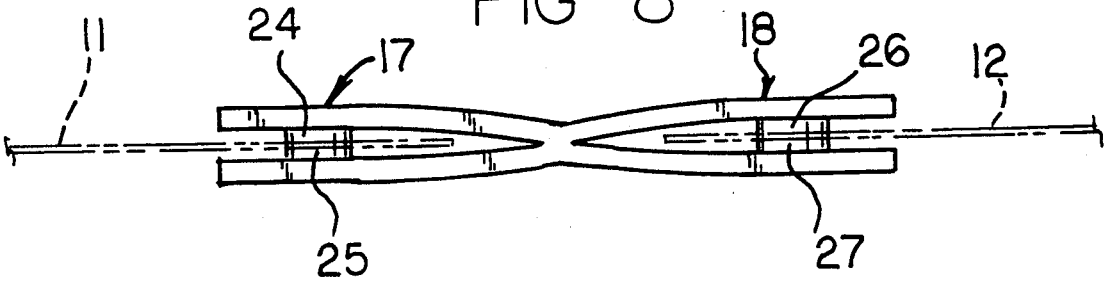
FIG. 8 is an orthographic end view of the organization employing the mechanical fastening structure in use.

Additionally, the organization may optionally include, as indicated in the FIGS. 5–6, first snap fastener plugs 24 mounted to the first web's first interior surface 19 cooperative with second web sockets 25. Similarly, first web second interior surfaces 21 may be provided with second snap fastener plugs 26 cooperative with second snap fastener sockets 27 mounted to the second web second interior surface 22. In this manner in addition to the adhesive layer 23 coextensive with the interior surfaces, the plug and socket structure provide for additional and mechanical fastening of the paper sheets together, with the plugs formed with an annular free cutting edge to simultaneously cut the paper sheet when directed into an accompanying socket structure, as indicated in FIG. 8.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A paper splice member, comprising, a first flexible web, wherein the first flexible web includes a predetermined length and a predetermined width, and a second flexible web, wherein the second flexible web includes a length equal to said predetermined length and a width equal to said predetermined width, the first flexible web medially intersecting the second flexible web, wherein the first flexible web and the second flexible web are coextensive relative to one another, and include a web intersection, with a web intersection longitudinally aligned having an intersection length equal to said predetermined length, and wherein the web intersection is of a flexible, shape-retentent construction, and a first web includes a first web first interior surface and a first web second interior surface on opposed sides of the intersection, and the second web includes a second web first interior surface and a second web second interior surface on opposed sides of the intersection, wherein the first web first interior surface and the second web first interior surface are in a confronting coextensive relationship relative to one another, and the first web second interior surface and the second web interior surface are in confronting coextensive relationship to one another, and each interior surface includes an adhesive layer coextensive with each interior surface.

2. A paper splice member as set forth in claim 1 wherein the first web first interior surface further includes a plurality of first snap fastener plugs, the second web first interior surface includes a plurality of snap fastener sockets, wherein the first snap fastener plugs have a free cutting edge for reception within the first snap fastener sockets, and the first web second interior surface includes a plurality of second snap fastener plugs having second plug cutting edges, and the second web second interior surface includes a plurality of second snap fastener sockets to receive the second snap fastener plugs therewithin.

* * * * *